US005469920A

United States Patent [19]

Conti et al.

[11] Patent Number: 5,469,920

[45] Date of Patent: Nov. 28, 1995

[54] INFLATABLE PARTITION FOR FIGHTING MINE FIRES

[75] Inventors: Ronald S. Conti; Charles P. Lazzara, both of Pittsburgh, Pa.

[73] Assignee: The United States of America as represented by the Secretary of the Interior, Washington, D.C.

[21] Appl. No.: 148,310

[22] Filed: Nov. 8, 1993

[51] Int. Cl.[6] ..... A62C 3/02

[52] U.S. Cl. ..... 169/48; 169/64; 52/2.11

[58] Field of Search ..... 169/48, 49, 54, 169/64, 91; 52/2.11; 454/169, 170; 405/132, 150.1; 299/12; 49/34, 477.1

[56] References Cited

U.S. PATENT DOCUMENTS

| | | | |
|---|---|---|---|
| 4,036,024 | 7/1977 | Dreker et al. | 405/289 X |
| 5,188,186 | 2/1993 | Nash | 169/64 X |

FOREIGN PATENT DOCUMENTS

| | | | |
|---|---|---|---|
| 560069 | 5/1977 | U.S.S.R. | 169/64 |
| 708061 | 1/1980 | U.S.S.R. | 169/64 |
| 1660707 | 7/1991 | U.S.S.R. | 169/64 |
| 1442139 | 7/1976 | United Kingdom | 169/64 |

*Primary Examiner*—David M. Mitchell
*Assistant Examiner*—Andrew C. Pike
*Attorney, Agent, or Firm*—E. Philip Koltos

[57] ABSTRACT

The seal is a lightweight, inflatable, bag which may be inflated by a portable air generator and is used to seal a burning mine passage. A collapsible tube-like aperture extends through the seal and allows passage of high expansion foam through the seal in a feed tube. The foam fills the passageway and extinguishes the fire. In other embodiments, the feed tubes incorporate means to prevent collapse of the aperture. In these embodiments a shroud connects the feed tube to a foam generator. This seal allows creation of a high expansion foam fire fighting barrier even in upward sloping passages.

5 Claims, 5 Drawing Sheets

INFLATABLE PARTITION FOR FIGHTING MINE FIRES

BACKGROUND OF THE INVENTION

This invention relates to extinguishing fires in a mine or other subterranean environment of solid natural material. In particular, this invention relates to means for isolating the fire and extinguishing it using high expansion foam.

High expansion foam is a proven and effective means for controlling and extinguishing fires in mines.

Under certain circumstances, especially when the fire is in an upward sloping passage from the foam generator, it is necessary to construct a partition or seal to separate the foam generator from the fire site. The partition prevents the high expansion foam from flowing back toward and engulfing the foam generator.

Current practices involve the construction of a partition to isolate the foam generator from the passageway which contains the fire. Concrete block, wood framing, plastic sheeting, brattice, or similar materials have been used for such partitions. Passageways often have irregular dimensions to which a partition must conform to avoid leakage around the periphery of the partition. Construction of such partitions is a time consuming process.

After the partition is made, a hole must be cut through it to allow passage of the high expansion foam from the foam generator to the fire site. Cutting a hole in the partition can be a labor intensive, time consuming, and dangerous process, depending on the construction materials, and often results in a partition with substantial leakage around the high expansion foam feed tube.

U.S. Pat. No. 3,831,318 discloses stored mine passage barriers formed of inflatable bags. Such bags are inflated with combustion suppressing agent when an explosion is detected by associated sensors.

U.S. Pat. No. 4,023,372 discloses flexible barriers used to close a mine passage having a gas-inflated peripheral portion which enables the barrier to conform to the walls of the passage. A web extending from the peripheral portion closes the passage. The web has a passage closed by a zipper.

U.S. Pat. No. 4,102,138 discloses a flexible portable barrier used to close off a mine gallery consisting of a flexible bag which is initially inflated with a gas and subsequently filled with hydraulic cement. The barrier has a crawl tube which extends through the barrier and may be closed with a cover.

U.S. Pat. No. 5,188,186 discloses a flexible expandable barrier stored in the ceiling of a mine. In response to a stimulus detected by a monitor, a foam-like material fills the barrier, causing it to extend and isolate the mine entry. A closable opening or flap allows passage through the barrier.

These prior art inventions do not fulfill the need for a portable, rapidly deployed partition or seal having means for passage of a feed tube from a high expansion foam generator.

SUMMARY OF THE INVENTION

This invention is a portable rectangular inflatable bag-like seal, partition or barrier which is transported to a burning mine passageway and inflated by an air blower or other source of compressed gas. The inflated seal isolates the burning portion of the mine. Traversing the seal is an aperture which is a cylindrical passage lined with the fabric of the bag and which is collapsible. A feed tube is passed through the aperture and conveys high expansion foam from a foam generator on one side of the seal to the other side of the seal, allowing the foam generator to fill the passageway with foam.

In one embodiment, a collapsible feed tube is used. The pressure of the foam in the tube exceeds the pressure of air in the seal, thereby keeping the aperture open. When the foam generator is turned off, the aperture collapses and no longer affords passage through the seal.

In a second and third embodiment a resilient feed tube is used. A shroud is used to convoy high expansion foam from a foam generator to the feed tube. The resilience of the feed tube overcomes the pressure of the air in the seal and prevents collapse of the aperture. In these embodiments, the shroud collapses when the foam generator is turned off, thus preventing flow of high expansion foam back toward the foam generator. Alternatively, the shroud may be tied off with a cord to prevent flow of high expansion foam when the foam generator is turned off.

The objective of this invention is to provide a lightweight means for rapidly sealing a large opening in a mine to isolate and fight a mine fire.

Another objective is to provide for delivery of high expansion foam through a mine seal.

Another objective is to facilitate the filling of an upward sloping mine passage with high expansion foam.

Another objective is to provide a readily closed passageway seal.

A final objective is to provide an inexpensive, portable, and rapidly and easily installed passageway seal.

DETAILED DESCRIPTION OF THE EMBODIMENTS

High expansion foam is a proven means of controlling and extinguishing fires. To effectively use this method for remotely fighting fires in underground mine passageways and in vehicular tunnels, it is often necessary to construct at some distance from the fire site in fresh air a partition or barrier or seal to separate the foam generator from the smoke and toxic fire products. If this is not done, the high expansion foam will flow back over the foam generator, rendering the fire attack futile. The problem is especially acute when the fire is located in an upward sloping passage.

This invention provides a rapidly deployed means to isolate the affected passageway and simultaneously provide a feed through for the high expansion foam.

Figure 1:
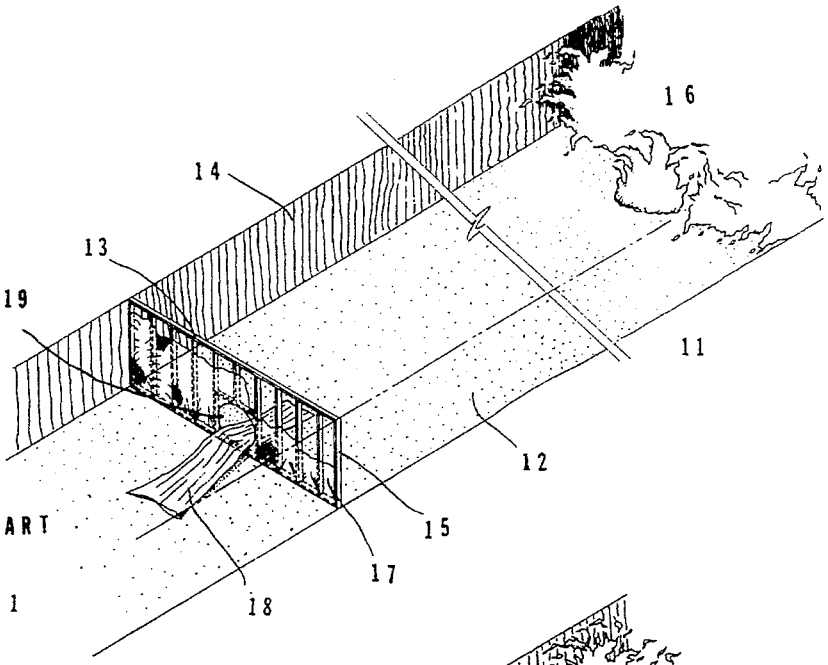
PRIOR ART FIG. 1
FIG. 1 is a diagrammatic view of a burning mine passageway showing a conventional barrier and feed tube.

FIG. 1 shows a burning mine passageway 11 with a passageway floor 12, passageway wall 14, and fire 16. A conventional prior art partition 13 is shown. This partition is constructed of a wooden frame 15 with a fabric cover 17. A hole 19 has been constructed in the partition. A collapsible feed tube 18 extends through the partition.

Figure 2:
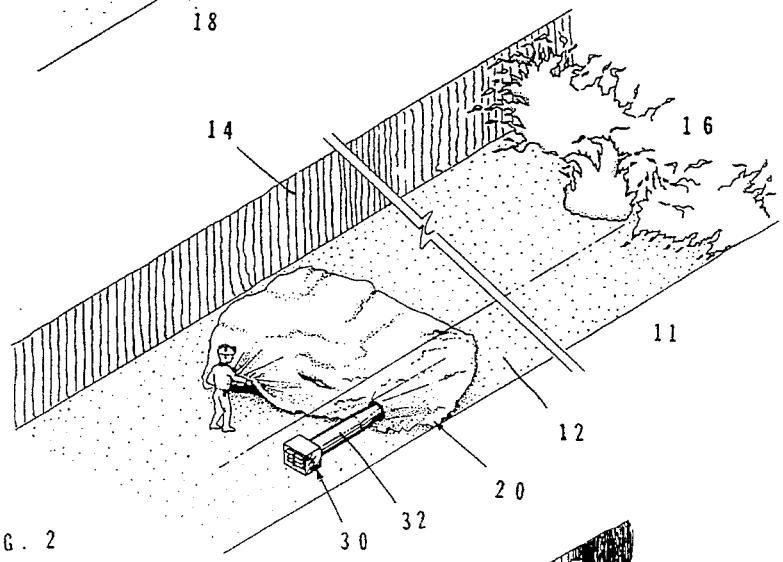
FIG. 2 is a diagrammatic view of a burning mine passageway showing inflation of the seal of the present invention.

FIG. 2 shows the burning mine passageway of FIG. 1. A seal of this invention 20 is being deployed in the passageway. The seal is being inflated by air provided by a fan 30 attached to the seal by an air tube 32.

Figure 3:
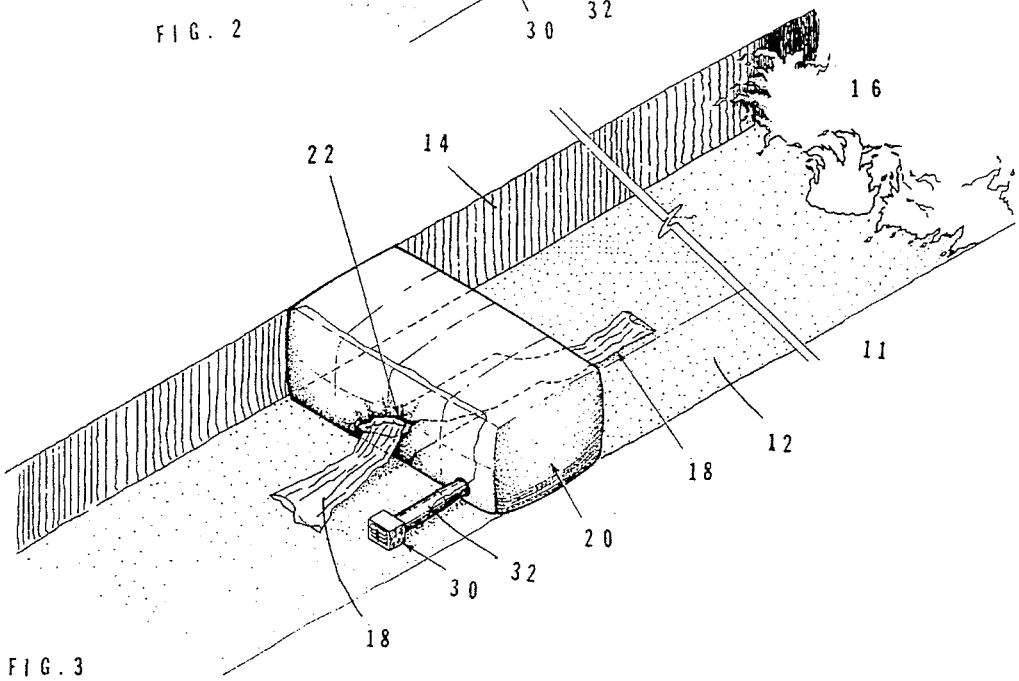
FIG. 3 is a diagrammatic view of a burning mine passageway showing the seal after inflation.

FIG. 3 shows the burning mine passageway of FIG. 1. Inflation of the seal 20 has been completed and the passageway has been blocked by the seal. A collapsible feed tube 18 extends through the aperture 22. The aperture has collapsed thereby closing the aperture and the feed tube. Air pressure in the seal is maintained by the fan 30 and air tube 32.

Figure 4:
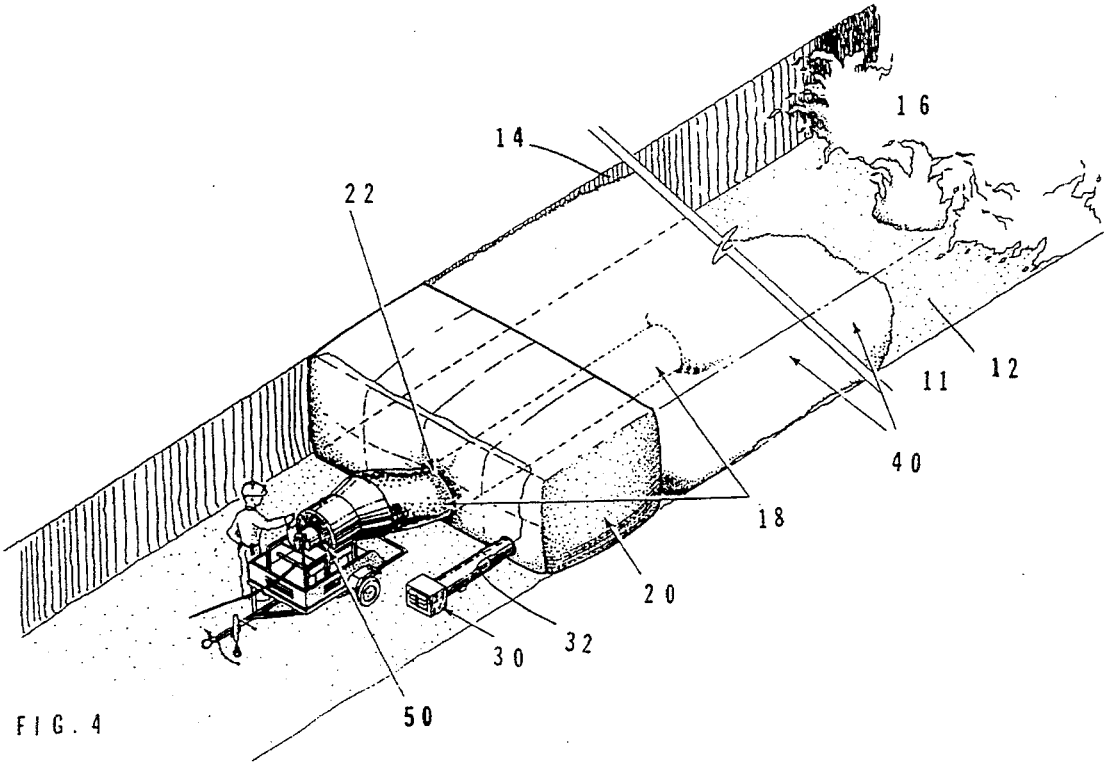
FIG. 4 is a diagrammatic view of a burning mine passageway showing generation of high expansion foam.

FIG. 4 shows the burning mine passageway of FIG. 1. A foam generator 50 feeds foam through the collapsible feed tube 18 which extends from the generator through the aperture 22 and into the other side of the seal. Foam 40 is filling the passageway. Air pressure in the seal is maintained by the fan 30 and air tube 32.

Figure 5:
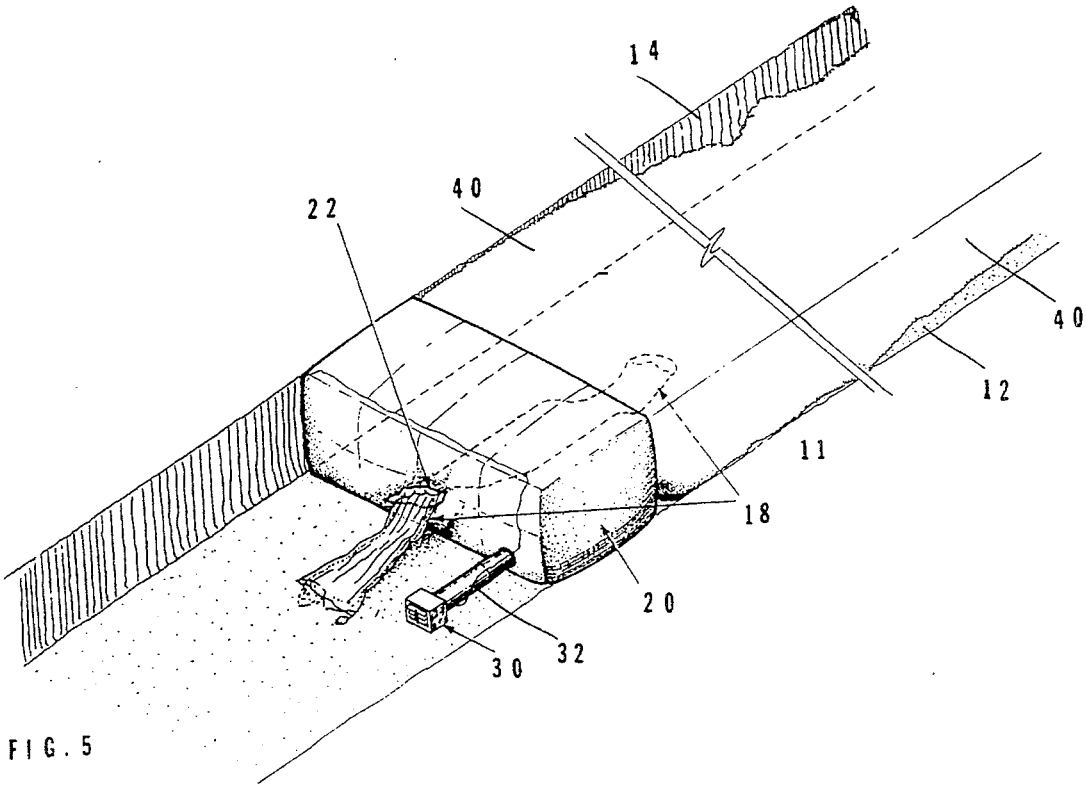
FIG. 5 is a diagrammatic view of a burning mine passageway after the foam has filled the passageway.

FIG. 5 shows the burning mine passageway of FIG. 1. The passageway has been filled with foam 40 and the foam generator has been removed. The aperture 22 and the collapsible feed tube 18 have collapsed, thereby sealing the passageway. Air pressure in the seal is maintained by the fan 30 and air tube 32.

Figure 6:
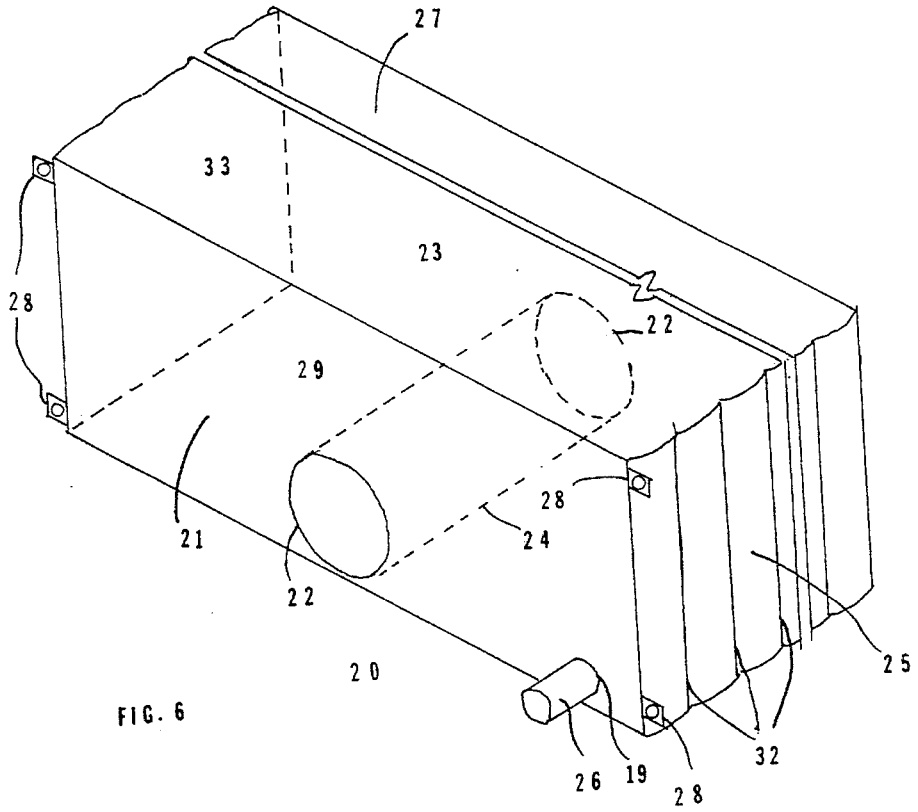
FIG. 6 is a diagrammatic elevation view of the seal.

FIG. 6 shows the seal as inflated. The seal 20 is rectangular in shape, having a front side 21 on the side of the foam generator, a back side 23 on the side of the fire, left end side 33, right end side 25, top side 27, and bottom side 29. Folds 32 in the end sides aid in conforming the seal to the surface of the passageway walls and preventing the seal from slipping due to the forces generated by the propagating foam plug.

The aperture 22 is a hole in the front side 21 and back side 23. An aperture wall 24 is a cylinder made of the same fabric as that of the seal and is attached to the front side 21 and the back side 23 at the apertures. Thus the aperture is a passage which extends through the seal from the front side to the back side. The aperture collapses when the pressure within the aperture is exceeded by the pressure in the seal. When a collapsible feed tube extends though the aperture, the aperture and feed tube will collapse when the pressure within the feed tube is less than that in the seal. This is important when high expansion foam is being generated. The pressure of the foam exceeds that of the seal, typically about 0.02 psig; therefore the aperture remains open and foam may flow through the feed tube and aperture. When foam generation ceases, the aperture and feed tube collapse, closing the passage through the seal.

The seal is inflated by a source of air through an air tube extension 26 connected to an air hole 19. A preferred source is an electric fan which is operated continually while the seal is in place. Other sources of air or other gases may be used, such as compressed air from cylinders. The seal typically is inflated to about 0.02 psig with air.

The seal is fabricated from a water- and heat-resistant, gas impermeable, lightweight material, preferably from chemically treated, rip-stop nylon. Other suitable materials may be used, such as MYLAR, a trademark for a brand of fiber forming polyesters. The shape of the seal and dimensions depend to a certain degree on the dimensions of the passageway in which it is to be used. A mine entry 7 feet high by 18 feet wide would take a seal in the shape of a slightly oversized rectangular bag approximately 8½ feet high by 20 feet wide by 10 feet long. The dimensions may be adopted to the size of the passageway to be sealed.

Figure 7:
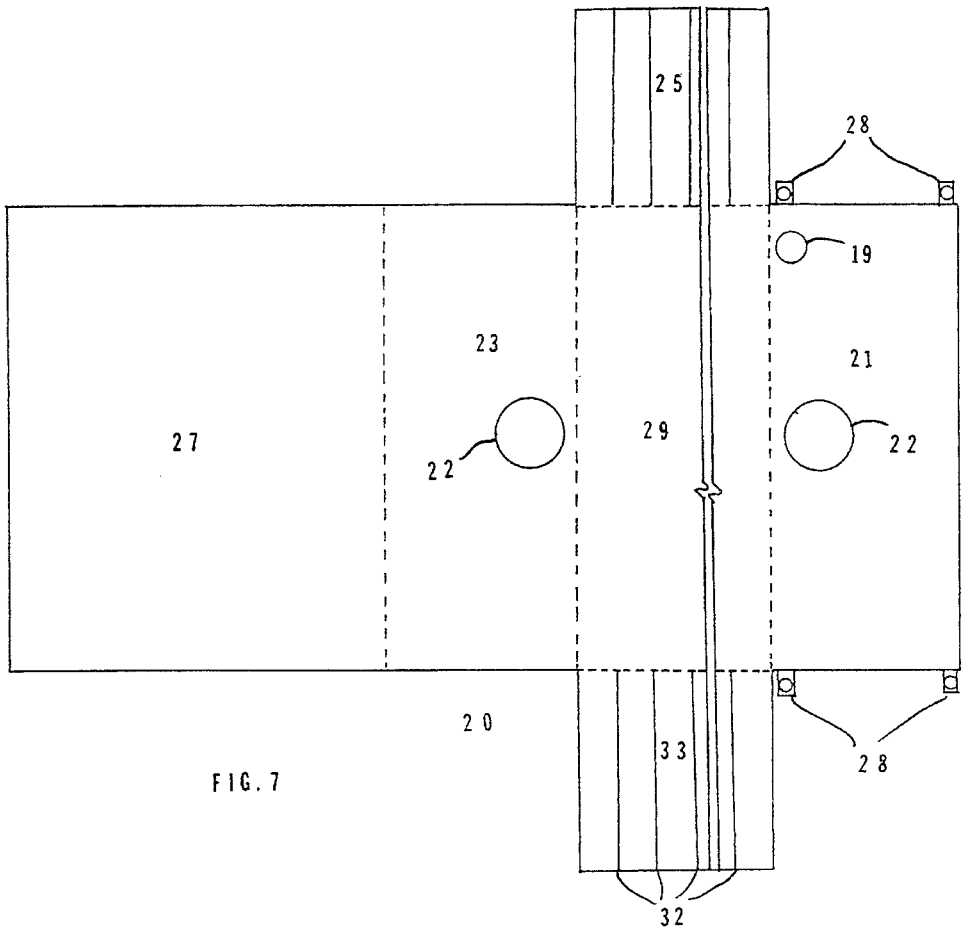
FIG. 7 is a pattern of fabric used in construction of the seal.

FIG. 7 is a pattern for construction of the seal from a single piece of fabric. In this FIG. 7 fold lines are indicated by dashed lines. Shown in FIG. 7 is the front side 21, back side 23, left end side 33, right end side 25, top side 27, and bottom side 29. Folds on left and right end sides are indicated at 32. The aperture openings are at 22 on the front and back sides. Attachment tabs with grommets are shown on the front side at 28.

The seal may be attached to the passageway walls using attachment tabs 28 and conventional fasteners, such as bolts.

The first embodiment feed tube in FIGS. 1–5 is a collapsible feed tube 18. It is constructed of plastic or any other suitable flexible strong and waterproof material.

Figure 8:
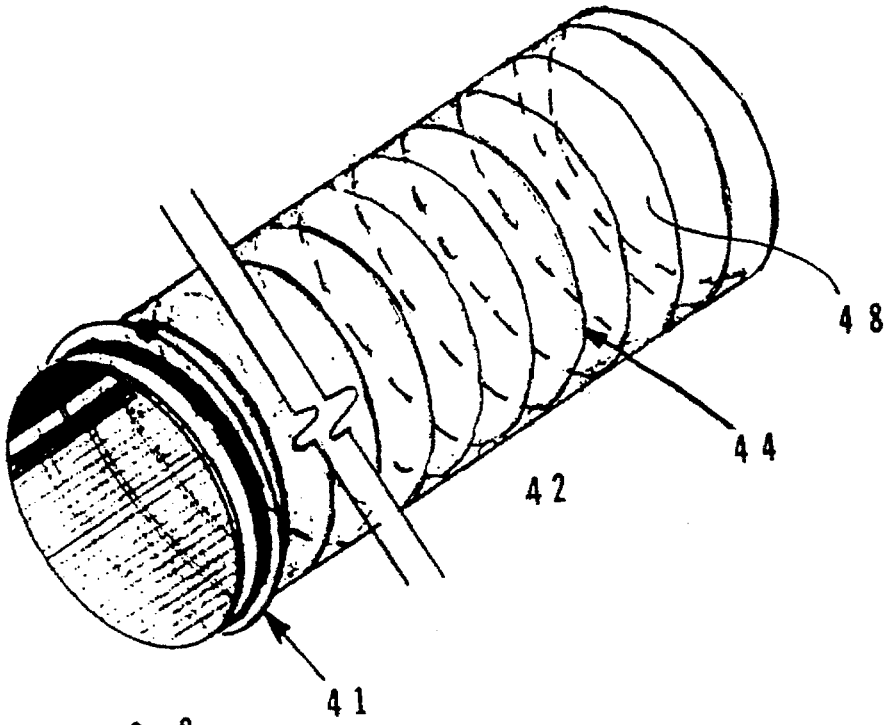
FIG. 8 is a diagrammatic view of the second embodiment feed tube.

FIG. 8 shows the second embodiment of feed tube, a resilient feed tube. A resilient feed tube does not collapse but has strength which maintains it in a cylindrical form. A resilient feed tube has the strength to resist the tendency of the aperture to collapse. An aperture in the seal is maintained open when a resilient feed tube is in place. In this second feed tube embodiment 42 an otherwise collapsible feed tube 48 is kept open by a wire stay 44 which is a helical wire which extends the length of the feed tube. A preferred wire stay is made of 8 gage wire. The second feed tube embodiment is not collapsed in use. When the foam generator is turned off, the flow of foam back toward the flow generator is prevented by the collapse or tying off of the shroud which connectes the foam generator with the feed tube. Flange 41 connects feed tube and seal.

Figure 9:
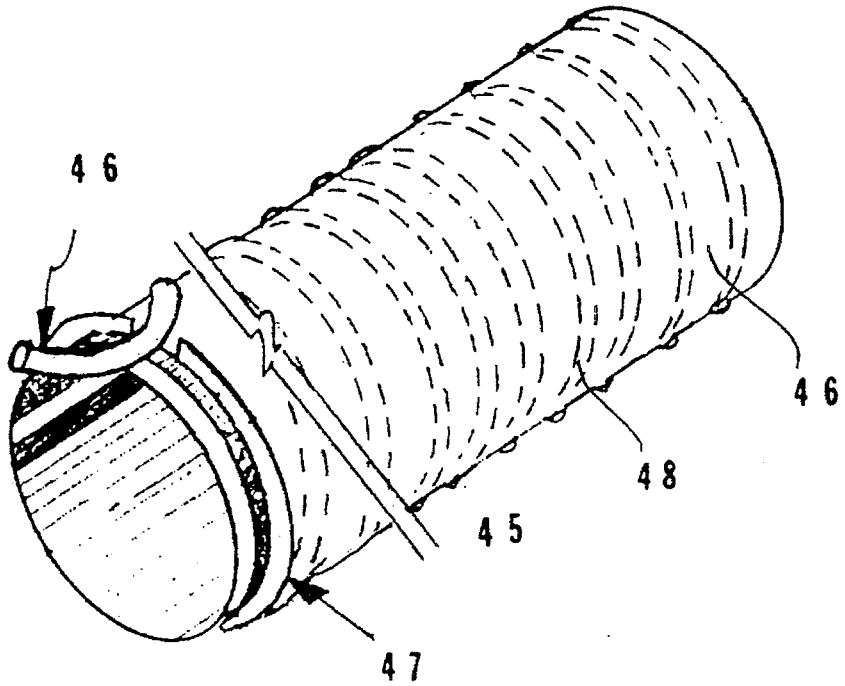
FIG. 9 is a diagrammatic view of the third embodiment feed tube.

FIG. 9 shows the third embodiment of the feed tube, which is also a resilient feed tube. In this third feed tube embodiment 45 an otherwise collapsible feed tube 48 is kept open by an air inflated closed tube or air stay 46 which has a helical shape and which extends the length of the feed tube. The tube 46 is deflated, causing the feed tube to collapse, and the aperture to close, when it is desired to close the aperture. Flange 47 connects feed tube and seal.

Figure 10:
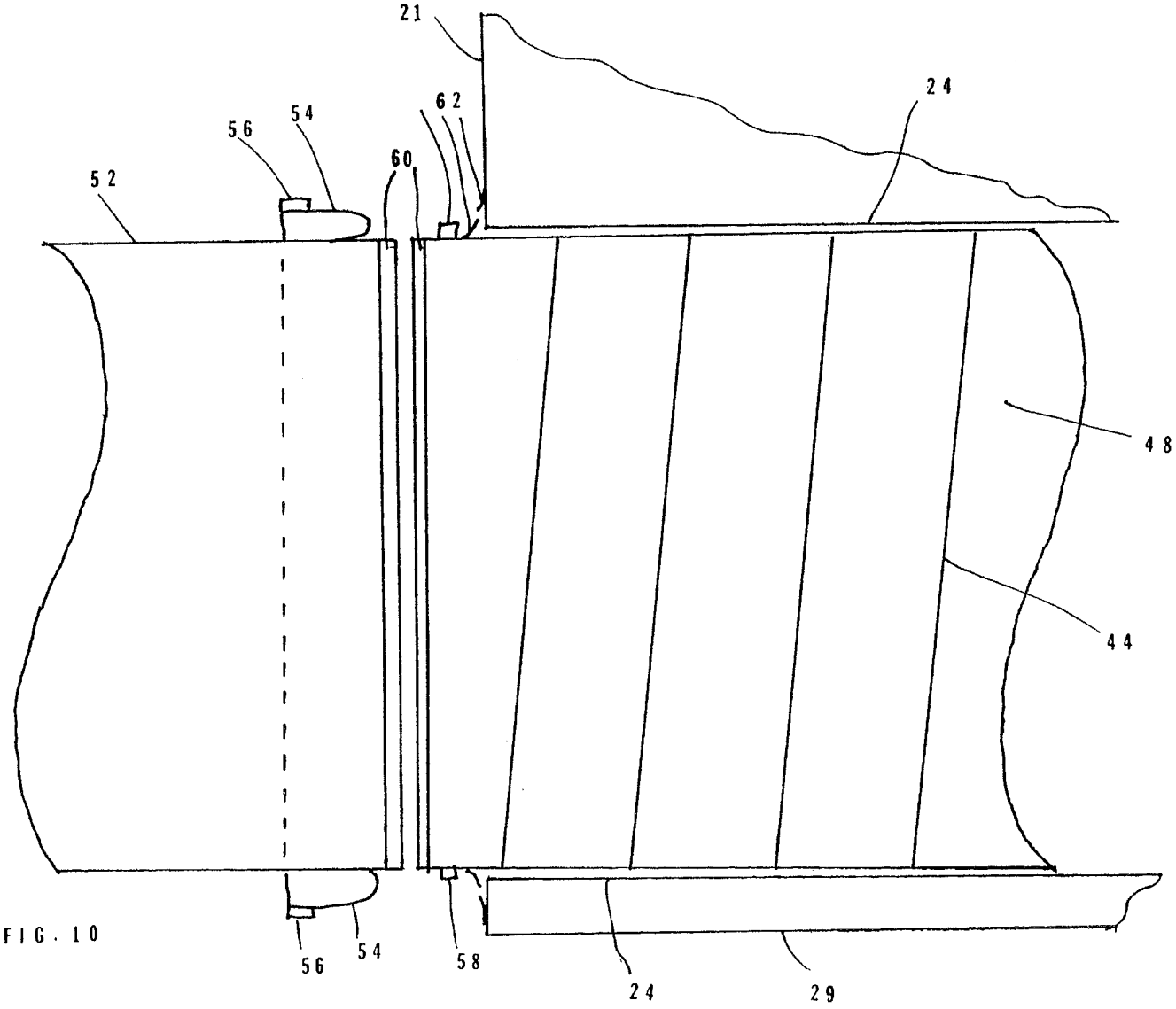
FIG. 10 is a diagrammatic view showing connection of the seal, second embodiment feed tube, and shroud.

FIG. 10 is a perspective showing a second embodiment feed tube 42 which extends from the front side 21 of a seal. The bottom 29 of the seal and the aperture wall 24 are shown. The second embodiment feed tube is attached to the front side of the seal 21 by a zipper 62 which extends around the circumferences of the aperture and of the feed tube. A tubular shroud 52 is used to convey high expansion foam from the foam generator to the feed tube. The shroud 52 is attached to the feed tube by a zipper 60 which extends around the circumferences of the shroud and of the feed tube. A shroud flap 54 is used to further seal the shroud-feed tube connection. The shroud flap attaches to the feed tube by hook and loop attachment means such as VELCRO, a trademark for a brand of hook and loop fasteners, strips which extend about the circumferences of the shroud flap 56 and the feed tube 58.

EXAMPLE 1

A seal using a first embodiment collapsible feed tube was placed in a mine with entry dimensions of 7 feet high and 18 feet wide. The passageway had a 1% rise. An electric fan was used to inflate the seal at 0.02 psig. A diesel-powered high expansion foam generator which produced 6,000 cubic feet of high expansion foam per minute was used to propagate foam through the feed tube and aperture into the entry for 200 feet, including filling a crosscut. After the foam was propagated, the foam generator was turned off and the feed tube and aperture self-sealed as depicted in FIG. 5.

It will be apparent to those skilled in the art that the examples and embodiments described herein are by way of illustration and not of limitation, and that other examples may be utilized without departing from the spirit and scope of the present invention, as set forth in the appended claims.

We claim:

1. A portable air-inflatable seal for isolating a fire in an underground passageway for passage of high expansion foam at a pressure generated by a foam generator from one side of the seal to another side of the seal, said seal comprising:

an air-inflatable rectangular bag fabricated of water- and heat-resistant material having an aperture for passage of the high expansion foam from one side of the bag to another side of the bag, said aperture comprising a cylindrical, collapsible fabric-lined passageway;

means for inflating the bag with air at a pressure for sealing the underground passageway and for collapsing the aperture closed; and a collapsible feed tube passing through the aperture for conducting the high expansion foam from the foam generator through the seal when the foam pressure is greater than the air pressure;

wherein said air pressure collapses both the aperture closed and the feed tube closed when the foam is not being generated.

2. The seal of claim 1 wherein the seal has attachment means for securing the seal to the underground passageway.

3. The seal of claim 2 wherein the attachment means are tabs having grommets.

4. The seal of claim 1 wherein the means for inflating the bag with air comprises an electric fan connected to the bag by an air tube.

5. The seal of claim 1 wherein the material is a lightweight, gas impermeable fabric.

* * * * *